US009664059B2

(12) United States Patent
Feldmann et al.

(10) Patent No.: US 9,664,059 B2
(45) Date of Patent: May 30, 2017

(54) SEALING DEVICE AND TURBOMACHINE

(71) Applicant: MTU Aero Engines AG, Munich (DE)

(72) Inventors: Manfred Feldmann, Eichenau (DE); Thomas Hess, Munich (DE)

(73) Assignee: MTU AERO ENGINES AG, Munich (DE)

( * ) Notice: Subject to any disclaimer, the term of this patent is extended or adjusted under 35 U.S.C. 154(b) by 0 days.

(21) Appl. No.: 14/312,291

(22) Filed: Jun. 23, 2014

(65) Prior Publication Data

US 2015/0001811 A1 Jan. 1, 2015

(30) Foreign Application Priority Data

Jun. 27, 2013 (DE) ..... 10 2013 212 480

(51) Int. Cl.
*F01D 11/02* (2006.01)
*F01D 11/00* (2006.01)

(52) U.S. Cl.
CPC ..... *F01D 11/02* (2013.01); *F01D 11/001* (2013.01); *F05D 2230/30* (2013.01)

(58) Field of Classification Search
CPC ..... F16J 15/441; F01D 5/225; F01D 11/08; F01D 11/02
USPC ..... 277/412, 413; 415/173.5
See application file for complete search history.

(56) References Cited

U.S. PATENT DOCUMENTS 2,963,307 A * 12/1960 Bobo ..... 277/414
3,565,545 A * 2/1971 Bobo et al. ..... 416/90 R
4,767,267 A * 8/1988 Salt et al. ..... 415/173.7
4,820,116 A * 4/1989 Hovan et al. ..... 415/115
4,869,640 A * 9/1989 Schwarz et al. ..... 415/115
5,080,557 A * 1/1992 Berger ..... 415/173.3
5,215,435 A 6/1993 Webb et al.
5,224,822 A * 7/1993 Lenahan et al. ..... 415/189
5,545,004 A * 8/1996 Ho et al. ..... 415/115
5,816,776 A * 10/1998 Chambon et al. ..... 415/174.5
6,220,815 B1 * 4/2001 Rainous et al. ..... 415/174.5
6,481,959 B1 * 11/2002 Morris et al. ..... 415/115
6,524,065 B2 * 2/2003 Briesenick ..... F01D 11/00 415/173.7

(Continued)

FOREIGN PATENT DOCUMENTS

DE 19931765A1 A1 1/2001
FR 2982314 A1 5/2013
WO WO2009118490 A2 10/2009

*Primary Examiner* — Kristina Fulton
*Assistant Examiner* — Eugene G Byrd
(74) *Attorney, Agent, or Firm* — Barlow, Josephs & Holmes, Ltd.

(57) ABSTRACT

A sealing device (1) is disclosed for sealing a radially inner gas channel (2) between a guide vane ring (4) and a rotor (6) of a turbomachine, wherein the sealing device (1) has a sealing ring (8) for forming a sealed space (10) with a rear segment with an inner wall structure (30) oriented in the opposite direction, which are joined to each other via an annular arch (32), wherein the radial flange (18) transitions into the outer wall structure (28) and the cylinder (26) forms the sealing ring (8), wherein the inner wall structure (30) transitions, via an annular web (36), into at least one inner body segment (38, 50), wherein the sealing device (1) has a uniform, preferably relatively reduced wall thickness over its individual segments integrally formed with one another, so that the sealing device (1) is resilient within certain limits.

16 Claims, 1 Drawing Sheet

(56) References Cited

U.S. PATENT DOCUMENTS

| | | | | |
|---|---|---|---|---|
| 7,048,497 | B2 * | 5/2006 | Arilla et al. | 415/116 |
| 7,341,429 | B2 * | 3/2008 | Montgomery et al. | 416/97 R |
| 8,133,010 | B2 * | 3/2012 | Dakowski et al. | 415/119 |
| 8,206,080 | B2 * | 6/2012 | Howe et al. | 415/58.4 |
| 8,662,835 | B2 * | 3/2014 | Fachat et al. | 415/173.5 |
| 2009/0129916 | A1 * | 5/2009 | Young et al. | 415/115 |
| 2014/0105725 | A1 * | 4/2014 | Stiehler | 415/115 |

* cited by examiner

SEALING DEVICE AND TURBOMACHINE

BACKGROUND OF THE INVENTION

The invention relates to a sealing device for a turbomachine, as it is known, for example, from WO 2009/118490 A2, as well as a turbomachine.

In order to seal a radially inner gas channel between a guide vane ring and a rotor of a turbomachine, such as a gas turbine, and, in particular, an aircraft engine, so-called fish mouth seals are used, for which a peripheral essentially cylindrical rotor ring of a row of rotating blades rotates in an annular sealed space, which is delimited by a radially inner stator ring and a radially outer stator ring of the guide vane ring. Vortexing arises in the sealed space, by means of which a feed of hot gas from the heating gas channel into the inner gas channel will be prevented.

The two stator rings conventionally have very different temperatures, so that the fish mouth seals must be configured in such a way that resulting thermal expansions are kept within an acceptable stress level or are reduced.

Additionally, for sealing the inner gas channel, a flow around the guide vane ring between the row of guide vanes and a rotor drum must be prevented, which is usually effected by a labyrinth seal inside the inner gas channel.

Basically, the following two constructions are known for the formation of fish mouth seals: In a first construction, the inner stator ring is formed integrally with the outer stator ring of the guide vane ring This construction, however, leads not rarely to the formation of cracks in the hot transition region between the stator rings, due to the thermally caused stresses. In a second construction, the inner stator ring is screwed to a front radial flange of the guide vane ring. The second construction in fact displays a better behavior relative to the thermally induced stresses in the fish mouth seal, but creates a potentially large leakage surface due to the contact of the inner stator ring at the guide vane ring.

BRIEF SUMMARY OF THE INVENTION

An object of the invention is to create a sealing device for sealing a radially inner gas channel between a guide vane ring and a rotor of a turbomachine, such as a gas turbine, which eliminates the above-named disadvantages and makes possible a radial thermal expansion equilibration. Another object of the invention is to create a turbomachine with an improved seal of an inner gas channel between a guide vane ring and a rotor.

This object is achieved by a sealing device with the features of of the present invention as set forth below.

A sealing device according to the invention for sealing a radially inner gas channel between a guide vane ring and a rotor of a turbomachine has a sealing ring for forming a sealed space with a rear segment, when considered in the direction of a principal flow, of an integral inner ring of the guide vane ring, and a front platform overhang of a downstream row of rotating blades penetrates therein. According to the invention, the sealing device has an outer radial flange for connecting to the integral inner ring of the guide vane ring and a double-walled cylinder having an outer wall structure oriented in a first direction and having an inner wall structure oriented in the opposite direction, which are joined together via an annular arch, wherein the radial flange transitions into the outer wall structure and the cylinder forms the sealing ring. Proceeding from this, according to the invention, the inner wall structure transitions, via an annular web, into at least one inner body segment, which is oriented parallel to the first direction or to the opposite direction, for the radially inner uptake of a sealing structure, wherein the sealing device has a uniform, preferably relatively reduced wall thickness over its individual segments integrally formed with one another, so that the sealing device is resilient within certain limits, wherein, in particular, the annular arch and the annular web act as radial spring elements.

Due to the fact that the radial flange transitions directly into the cylinder, the cylinder is configured with a double wall in U shape or in hairpin form, and takes up the sealing ring, the sealing ring is mounted floating, and radial thermal expansions of the guide vane ring are equilibrated without excessive stresses. The sealing device can be joined cohesively with the guide vane ring, for example, by means of brazing, or by force-fitting and/or form-fitting with the guide vane ring. The force-fitting or the force/form-fitting, for example, by means of screwing together, is of a type such that leakage flows in the connection region between the guide vane ring and the radial flange of the sealing device are prevented.

In order to prevent a flow around the guide vane ring between the guide vane ring and a rotor drum, the inner wall structure transitions, via an annular web, into at least one inner body segment, which is oriented parallel to the first direction or to the opposite direction, for the radially inner uptake of a sealing structure. Therefore, the double-walled cylinder and the at least one inner body segment form a type of three-walled cylinder.

In order to avoid a disproportionate heat input via the annular web into the inner wall structure, and in order to achieve a certain elasticity of the body segments, the annular web is preferably relatively thin-walled.

For a compact example of embodiment, the sealing ring forms a bearing element of the cylinder. For this purpose, the outer wall structure can extend downstream, and the inner wall structure can extend upstream, wherein the sealing ring is an integral segment of the outer wall structure. For example, the sealing device may only have one inner body segment directed downstream for taking up a sealing structure.

In another example of embodiment, the inner wall structure forms the sealing ring. The outer wall structure can be directed upstream relative thereto, while in contrast, the inner wall structure is directed downstream. In this example of embodiment, the sealing ring is not a bearing structure of the cylinder, so that the sealing ring can have a geometry that is optimally adapted to its own proper sealing task. The sealing device may also have an upstream-directed inner body segment and a downstream-directed inner body segment for the uptake of a sealing structure. Due to the fact that one body segment extends downstream and one body segment extends upstream from the annular web, the latter is loaded essentially symmetrically or uniformly by the body segments. In order to keep the loads small that act on the radial flange due to the cylinder and/or due to the body segments, or to introduce loads acting on the sealing device nearly uniformly into the radial flange, it is advantageous if the radial flange is disposed approximately in the middle of the sealing device, when considered in the axial direction of the sealing device.

The sealing device may be optimally adapted relative to its shape and material structure to the respective rotor and stator geometry, if it is manufactured generatively. Also, the manufacturing effort and the production costs will be reduced by the generative manufacture, since a joining of a plurality of individual parts is dispensed with. Further, due to the generative manufacture, the sealing structure can be designed integrally with the body segments, so that it can also have an optimal shape and material structure, and, in addition, need not be fastened to the sealing device in a separate mounting step.

A preferred turbomachine has at least one sealing device according to the invention for sealing a radially inner gas channel. The sealing device can be connected cohesively, for example, by means of brazing, or joined in a force-fitting and/or form-fitting manner, for example, by means of a screw connection, to the inner ring of a guide vane ring. The inner gas channel is better sealed against the flow of hot gas by the radial thermal expansion equilibration, when compared to known sealing devices.

Other advantageous embodiment examples of the invention are discussed in detail below.

BRIEF DESCRIPTION OF THE DRAWINGS

Preferred embodiment examples of the invention will be explained in more detail in the following on the basis of schematic representations. Herein.

DETAILED DESCRIPTION OF THE INVENTION

Figure 1:
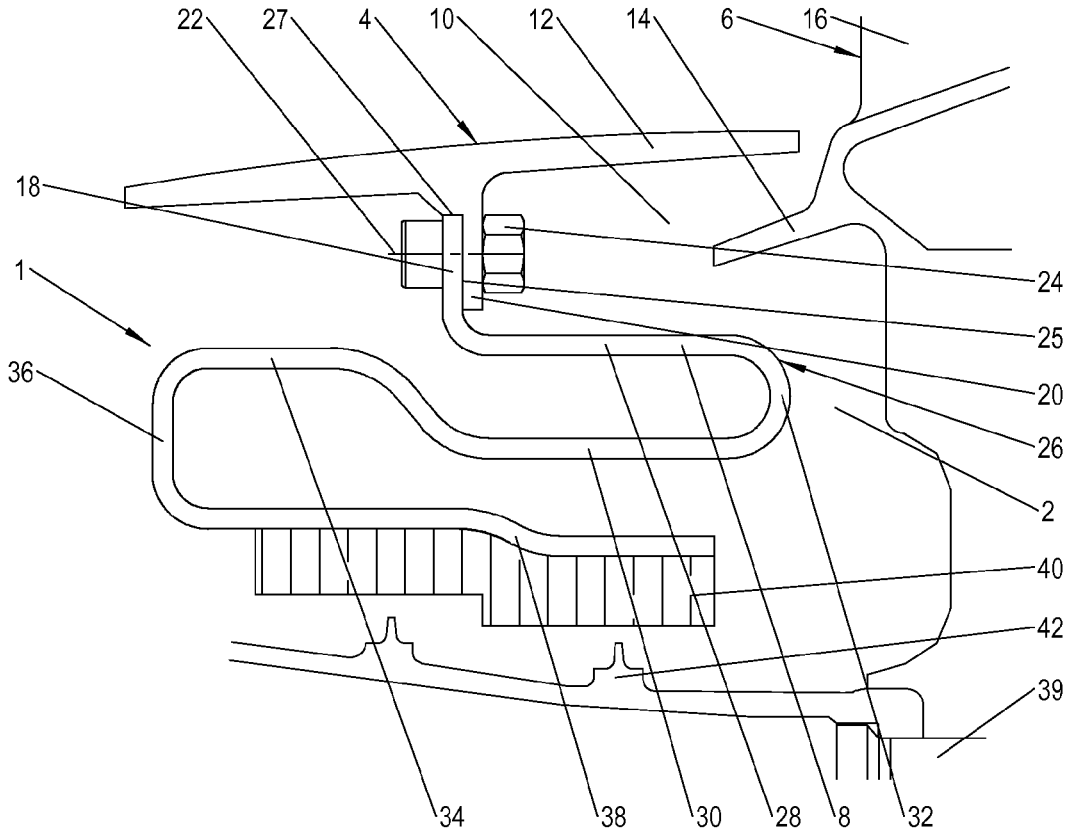
FIG. 1 shows a first example of embodiment of a sealing device according to the invention.

A first example of embodiment of a sealing device 1 according to the invention for sealing a radially inner gas channel 2 between a guide vane ring 4 and a rotor 6 of a turbomachine, such as a gas turbine, and, in particular, an aircraft engine, is shown in FIG. 1. The sealing device 1 has a sealing ring 8 for forming a sealed space 10 with a rear segment of an integral inner ring 12 of the guide vane ring 4. An integral front platform overhang 14 of a row of rotating blades 16 of the rotor 6, which rotates in the direction of a principal flow that flows through the turbomachine downstream of the guide vane ring 4 penetrates into the sealed space 10.

The sealing device 1 has a radial flange 18 oriented outwardly for the connection to the inner ring 12, and the inner ring 12 has an annular flange 20 directed inwardly for the uptake of the sealing device 1. In the example of embodiment shown, the sealing device 1 is connected by means of a plurality of fastening means 24, such as screw-nut systems, which are guided through boreholes 22 of the radial flange 18 and of the annular flange 20. In this case, the radial flange 18 is forcefully pressed against the annular flange 20 in such a way that a leakage flow cannot form between these flanges. Alternatively, the sealing device 1 can be connected to the inner ring 12 cohesively, for example, by means of brazing. For simplified alignment and also for making leakages difficult, a contact region is provided between the radial flange 18 and the annular flange 20 at an angle to an axial contact limit 25 and a radial contact limit 27.

In addition to the radial flange 18, the sealing device 1 has a double-walled cylinder 26, which runs approximately coaxial to the axial direction of the turbomachine in the mounted state. The cylinder 26 has an outer wall structure 28 and an inner wall structure 30, which are joined together via an annular arch 32. The cylinder 26 thus has a U-shaped or hairpin-like cross section, whereby different radial thermal expansions of the guide vane ring 4 relative to the sealing ring 8 can be equilibrated without excessive stress. In the example of embodiment shown, the sealing ring 8 is formed as an integral segment of the outer wall structure 28. Based on the coaxial position of the cylinder 26, the segment forming the sealing ring 8, or the sealing ring 8, runs approximately parallel to the rear segment of the inner ring 12.

The outer wall structure 28 forming the sealing ring 8 extends out from the radial flange 18 in a first direction, and downstream, in fact, according to the illustration in FIG. 1, and the inner wall structure 30 extends in the opposite direction, and upstream in fact, of the principal flow, according to the illustration in FIG. 1. The inner wall structure 30 is disposed radially inside relative to the outer wall structure 28 and has a wall segment 34 displaced radially outward, which runs approximately up to the radial height of the outer wall structure 28. The wall segment 34 transitions into a radially inner annular web 36, which transitions into a downstream directed inner body segment 38. Because of this, the sealing device 1 has an approximately S-shaped cross section.

The inner body segment 38 is disposed radially inside relative to the inner wall structure 30, and ends just in front of an axial position of the annular arch 32. In the example of embodiment shown, it is designed step-shaped and is provided in its side facing a rotor drum 39 with a sealing structure or run-in structure 40. The sealing structure 40 acts in combination with rotor-side sealing fins 42 as a labyrinth seal, by means of which a flow of the guide vane ring 4 in the region of its vane tips facing the rotor drum 39 is prevented.

As is shown in the section according to FIG. 1, the sealing device 1 preferably has a uniform wall thickness over its individual integral segments—radial flange 18, cylinder 26 with sealing ring 8, annular web 36, and inner body segment 38. The wall is relatively thin, whereby the sealing device 1 is not rigid, but also has spring or elastic properties. The annular arch 32 and the annular web 36 particularly act as radial spring elements. It can also be seen in FIG. 1 that the radial flange 18 is found approximately in the middle between an axial position of the annular web 36 and the axial position of the annular arch 32.

Preferably, the sealing device 1 is manufactured generatively, for example, by means of a laser sintering process or a selective laser melting process. The sealing device 1 is thus preferably produced as a single part in a single process.

Figure 2:
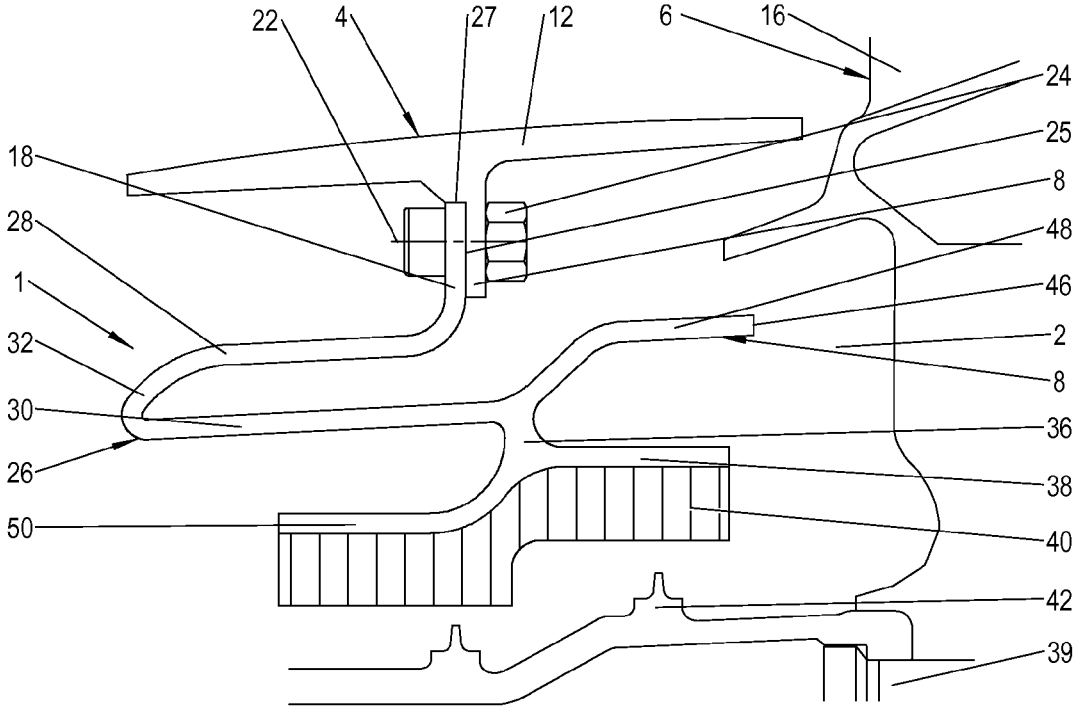
FIG. 2 shows a second example of embodiment of the sealing device according to the invention.

A second example of embodiment of the sealing device 1 according to the invention for a turbomachine is shown in FIG. 2. This example of embodiment also has a sealing ring 8, a radial flange 18, a double-walled cylinder 26 that runs coaxial to the axial direction of the turbomachine in the mounted state, an annular web 36, and a sealing structure 40.

An essential difference relative to the first example of embodiment according to FIG. 1 is that in this embodiment example, an outer wall structure 28 of the cylinder 26 extends upstream of a principal flow that flows through the turbomachine, and an inner wall structure 30 of the cylinder 26 that connects to the outer wall structure 28 via an annular arch 32 extends downstream of a principal flow that flows through the turbomachine.

Another essential difference is that the sealing ring 8 in this embodiment example is not formed as an integral segment of the outer wall structure 28, but rather as an integral segment that extends to the front from a free end of the inner wall structure 30. In the example of embodiment shown, the sealing ring 8 is provided in stepped shape, with a free peripheral edge 46 lying radially outward with respect to the inner wall structure 30 on a radial level of the outer wall structure 28. Preferably, the sealing ring 8 with its ring segment 48 displaced outwardly and forming the peripheral edge 46 runs approximately parallel to the rear segment of the inner ring 12 of the guide vane ring 4.

Another essential difference is that according to the embodiment example of FIG. 2, in addition to an inner body segment 38 extending downstream from an annular web 36, the sealing device 1 has an inner body segment 50 extending upstream, which are together provided with a continuous sealing structure 40.

As shown in the section according to FIG. 2, the sealing device 1 according to FIG. 2 also preferably has a uniform, relatively reduced wall thickness over its individual integral segments—radial flange 18, cylinder 26 with sealing ring 8, annular web 36, and inner body segments 38, 50—and is thus resilient within certain limits. The annular arch 32 and the annular web 36 particularly act as radial spring elements in this case. It can also be seen in FIG. 2 that the radial flange 18 is found approximately in the middle between an axial position of the annular web 32 and an axial position of the free peripheral edge 46 of the sealing ring 8.

Of course, a front fish mouth seal and thus a hub-side sealed space between an upstream or front row of rotating blades and the guide vane ring 4 can also be formed by the sealing device 1. In the drawing according to FIG. 1, the front sealed space would be formed between the inner wall segment 34 and the outer inner ring 12, whereby then the front row of guide vanes would penetrate by a rear platform overhang into this front sealed space.

A sealing device is disclosed for sealing a radially inner gas channel between a guide vane ring and a rotor of a turbomachine, wherein the sealing device has a sealing ring for forming a sealed space with a rear segment, when considered in the direction of a principal flow, of an integral inner ring of the guide vane ring, into which penetrates a front platform overhang of a downstream row of rotating blades, and wherein the sealing device has an outer radial flange for connecting to the integral inner ring of the guide vane ring and a double-walled cylinder having an outer wall structure oriented in a first direction and with an inner wall structure oriented in the opposite direction, which are joined together via an annular arch, wherein the radial flange transitions into the outer wall structure of the cylinder and the cylinder forms the sealing ring, as well as a turbomachine.

The invention claimed is:

1. A sealing device (1) for sealing a radially inner gas channel (2) between a guide vane ring (4) and a rotor (6) of a turbomachine, wherein the sealing device (1) has a sealing ring (8) for forming a sealed space (10) with a rear segment, when considered in the direction of a principal flow, of an integral inner ring (12) of the guide vane ring (4), into which penetrates a front platform overhang (14) of a downstream row of rotating blades (16), and wherein the sealing device (1) defines an S-shaped cross-section and has an outer radial flange (18) for connecting to the integral inner ring (12) and a double-walled cylinder (26) with an outer wall structure (28) oriented in a first direction and with an inner wall structure (30) oriented in the opposite direction, which are joined to each other via an a first annular radial spring element (32), wherein the radial flange (18) transitions into the outer wall structure (28) and the cylinder (26) forms the sealing ring (8);

wherein the sealing ring (8) is positioned approximately parallel to the rear segment of the inner ring (12);

wherein the inner wall structure (30) transitions, via a second annular radial spring element (36), into at least one inner body segment (38, 50), which is oriented parallel to the first direction or to the opposite direction, the at least one inner body segment has a radially inwardmost side that is configured to face a rotor drum having at least one seal fin thereon, and the at least one inner body segment supports a sealing structure (40) on its radially inward side, the sealing structure in combination with the at least one seal fin on the rotor drum forming a labyrinth seal directly against the drum by which a flow of the guide vane ring in the region of its vane tips facing the rotor drum is prevented; the sealing device (1), rotor drum (39), rotor (6) and inner ring (12) defining a sealed space (10) therebetween; and wherein the sealing device (1) has a uniform, preferably relatively reduced wall thickness over its individual segments integrally formed with one another, so that the sealing device (1) is resilient within certain limits, wherein, in particular, first annular radial spring element (32) and the second annular radial spring element (36) act as radial spring elements, whereby the sealing device forms a spring configured and arranged for equilibrating a radial thermal expansion of the guide vane ring.

2. The sealing device according to claim 1, wherein the outer wall structure (28) forms the sealing ring (8) and the outer wall structure (28) is directed downstream and the inner wall structure (30) is directed upstream.

3. The sealing device according to claim 2, wherein the at least one inner body segment (38) is directed downstream, when considered from the second annular radial spring element (36).

4. The sealing device according to claim 1, wherein the sealing ring (8) is formed on the inner wall structure (30), and the outer wall structure (28) is directed upstream and the inner wall structure (30) is directed downstream.

5. The sealing device according to claim 4, wherein one inner body segment (38) is directed downstream, when considered from the second annular radial spring element (36), and another inner body segment (50) is directed upstream, when considered from the second annular radial spring element (36).

6. The sealing device according to claim 1, wherein the radial flange (18) is disposed approximately in the middle of the sealing device (1), so that it is between an axial position of the second annular radial spring element (36) and the axial position of the first annular radial spring element (32), when considered in the axial direction.

7. The sealing device according to claim 1, wherein the sealing device (1) is manufactured generatively.

8. The sealing device according to claim 1, wherein at least one of the sealing device is configured and arranged for use in a turbomachine.

9. A sealing device (1) for sealing a radially inner gas channel (2) between a guide vane ring (4) and a rotor (6) of a turbomachine, wherein the sealing device (1) has a sealing ring (8) for forming a sealed space (10) with a rear segment, when considered in the direction of a principal flow, of an integral inner ring (12) of the guide vane ring (4), into which penetrates a front platform overhang (14) of a downstream row of rotating blades (16), and wherein the sealing device (1) defines an S-shaped cross-section and has an outer radial flange (18) for connecting to the integral inner ring (12) and a double-walled cylinder (26) with an outer wall structure (28) oriented in a first direction and with an inner wall structure (30) oriented in the opposite direction, which are joined to each other via an a first annular radial spring element (32), wherein the radial flange (18) transitions into the outer wall structure (28) and the cylinder (26) forms the sealing ring (8);

wherein the inner wall structure (30) transitions, via a second annular radial spring element (36), into at least one inner body segment (38, 50), which is oriented parallel to the first direction or to the opposite direction, the at least one inner body segment has a radially inwardmost side that is configured to face a rotor drum having at least one seal fin thereon, and the at least one inner body segment supports a sealing structure (40) on its radially inward side, the sealing structure in combination with the at least one seal fin on the rotor drum forming a labyrinth seal directly against the drum by which a flow of the guide vane ring in the region of its vane tips facing the rotor drum is prevented; the sealing device (1), rotor drum (39), rotor (6) and inner ring (12) defining a sealed space (10) therebetween;

wherein the sealing device (1) has a uniform, preferably relatively reduced wall thickness over its individual segments integrally formed with one another, so that the sealing device (1) is resilient within certain limits, wherein, in particular, the first annular radial spring element (32) and the second annular radial spring element (36) act as radial spring elements, whereby the sealing device forms a spring configured and arranged for equilibrating a radial thermal expansion of the guide vane ring; and wherein the sealing device (1) is configured for forming a front sealed space with a front segment, when considered in the direction of a principal flow, of an integral inner ring (12) of the guide vane ring (4), so the front sealed space is configured to be penetrated by a rear platform overhang of an upstream row of rotating blades.

10. The sealing device according to claim 9, wherein the outer wall structure (28) forms the sealing ring (8) and the outer wall structure (28) is directed downstream and the inner wall structure (30) is directed upstream.

11. The sealing device according to claim 10, wherein the at least one inner body segment (38) is directed downstream, when considered from the second annular radial spring element (36).

12. The sealing device according to claim 9, wherein the sealing ring (8) is formed on the inner wall structure (30), and the outer wall structure (28) is directed upstream and the inner wall structure (30) is directed downstream.

13. The sealing device according to claim 12, wherein one inner body segment (38) is directed downstream, when considered from the second annular radial spring element (36), and another inner body segment (50) is directed upstream, when considered from the second annular radial spring element (36).

14. The sealing device according to claim 9, wherein the radial flange (18) is disposed approximately in the middle of the sealing device (1), so that it is between an axial position of the second annular radial spring element (36) and the axial position of the first annular radial spring element (32), when considered in the axial direction.

15. The sealing device according to claim 9, wherein the sealing device (1) is manufactured generatively.

16. The sealing device according to claim 9, wherein at least one of the sealing device is configured and arranged for use in a turbomachine.

* * * * *